US006185441B1

(12) United States Patent
Wikborg et al.

(10) Patent No.: US 6,185,441 B1
(45) Date of Patent: Feb. 6, 2001

(54) ARRANGEMENT AND METHOD RELATING TO COUPLING OF SIGNALS TO/FROM MICROWAVE DEVICES

(75) Inventors: Erland Wikborg, Danderyd; Erik Carlsson, Mölndal; Spartak Gevorgian, Göteborg, all of (SE)

(73) Assignee: Telefonaktiebolaget LM Ericsson, Stockholm (SE)

( * ) Notice: Under 35 U.S.C. 154(b), the term of this patent shall be extended for 0 days.

(21) Appl. No.: 09/061,272

(22) Filed: Apr. 17, 1998

(30) Foreign Application Priority Data

Apr. 18, 1997 (SE) ..... 9701450

(51) Int. Cl.[7] ..... H01P 7/08; H01B 12/02

(52) U.S. Cl. ..... 505/210; 505/700; 505/701; 505/866; 333/219; 333/235; 333/99 S

(58) Field of Search ..... 333/219, 230, 333/235, 99 S; 505/210, 700, 701, 866

(56) References Cited

U.S. PATENT DOCUMENTS

| | | | | |
|---|---|---|---|---|
| 4,197,517 | | 4/1980 | Vittoria | 333/205 |
| 4,945,324 | | 7/1990 | Murakami et al. | 333/202 |
| 5,418,507 | | 5/1995 | Keane et al. | 333/202 |
| 5,472,935 | * | 12/1995 | Yandrofski et al. | 333/995 X |
| 5,604,471 | * | 2/1997 | Rattila et al. | 333/219 X |

FOREIGN PATENT DOCUMENTS

| | | |
|---|---|---|
| 43 43 940 | 6/1995 | (DE) . |
| 661 770 | 7/1995 | (EP) . |
| 506 303 | 12/1997 | (SE) . |
| WO96/42118 | 12/1996 | (WO) . |

OTHER PUBLICATIONS

K. Bethe, "Uber Das Mikrowellenverhalten Nichtlinearer Dielektrika" Philips Res. Reports, No. 2, pp. 44, Suppl. 1970.

S. Gevorgian et al., "Low Order Modes of YBCO/STO/YBCO Circular Disk Resonators", IEEE Trans. Microwave Theory and Techniques, vol. 44, No. 10, pp. 1738–1741 (Oct. 1996).

P. Guillon, *Dielectric Resonators*, chap. 8, p. 282; chap. 6.6 (1990).

T. Hayashi et al., "Coupling Structures for Super Conducting Disk Resonators," Electronics Letters, vol. 30, No. 17, pp. 1424–1425 (1994).

O.G. Vendik et al., "1 GHz Tunable Resonator on Bulk Single Crystal $SrTiO_3$ Plated with $YBa_2Cu_3O_{7-x}$ films" Electronics Letters, vol. 31, p. 654 (1995).

* cited by examiner

*Primary Examiner*—Benny T. Lee
(74) *Attorney, Agent, or Firm*—Burns, Doane, Swecker & Mathis, L.L.P.

(57) ABSTRACT

An arrangement for coupling electro magnetic waves, particularly microwaves, into and/or out of a device which includes a dielectric resonator having a non-linear dielectric substrate with a high dielectric constant and a coupling loop. The dimensions of the resonator and the coupling loop are related to the resonant frequency of the resonator. The coupling loop is so arranged in relation to the resonator that the magnetic field lines around the coupling loop match the internal film distribution of at least one mode, which has been selected to be excited, so that only that mode is excited. Coupling is provided only for this mode. The length of the coupling loop is comparable to or larger that the dimensions of the resonator.

26 Claims, 7 Drawing Sheets

FIG. 7
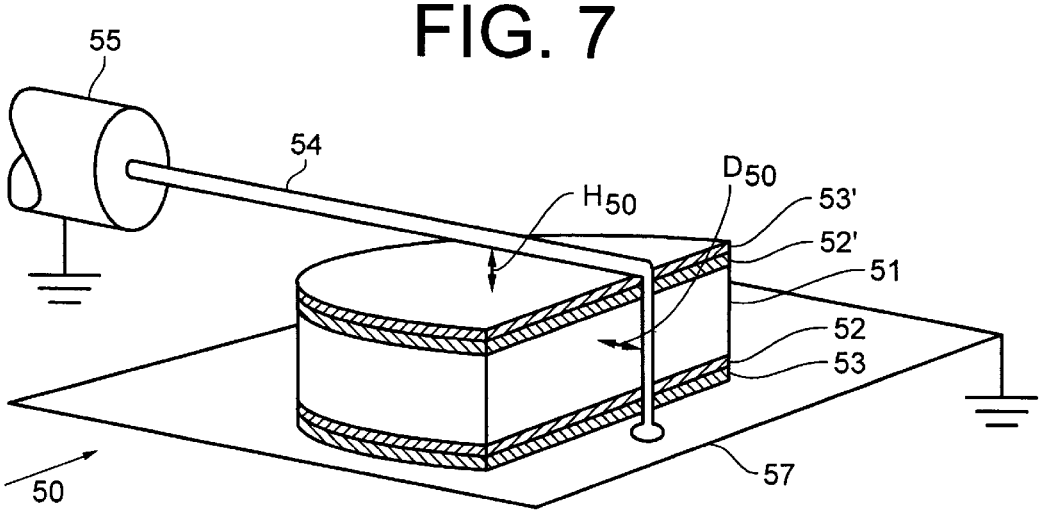
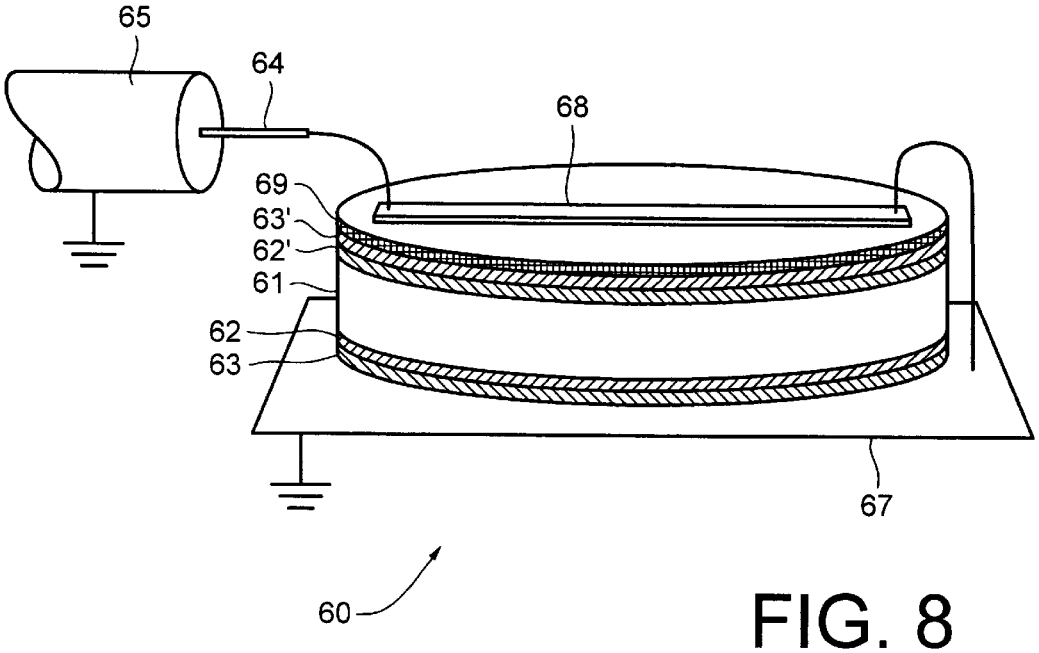
FIG. 8

ARRANGEMENT AND METHOD RELATING TO COUPLING OF SIGNALS TO/FROM MICROWAVE DEVICES

BACKGROUND

The present invention relates to an arrangement for coupling electromagnetic waves into and/or out of a microwave device which comprises at least one dielectric resonator. The dielectric resonator comprises a non-linear dielectric substrate with a high dielectric constant and coupling is provided through coupling loops.

Still further the invention relates to a method of coupling microwave signals into and/or out of a microwave device including at least one dielectric resonator with a non-linear dielectric substrate having a high dielectric constant.

Dielectric and parallel-plate resonators and filters for microwave frequencies using dielectric disks of any shape, for example circular, are known, see for example Vendik et. al., El. Lett., vol. 31, P. 654, 1995, which herewith is incorporated herein by reference. Parallel-plate resonators comprising a non-linear dielectric material with extremely high dielectric constants, for example ferroelectric materials or an antiferroelectric material, have small dimensions and can be used to provide very compact filters in the frequency band of 0.5–3.0 GHz which is the frequency band in which most advanced microwave communication systems operate today. Such non-linear dielectric materials may for example be STO (Strontium Titanate) which has a dielectric constant of about 2000 at the temperature of liquid nitrogen and a dielectric constant of about 300K at room temperature. As an example, the resonant frequencies of circular STO parallel-plate disk resonators having a diameter of 10 mm and a thickness of 0.5 mm are in the range of 0.2–2.0 GHz depending on the temperature and on the applied DC biasing. At these frequencies the wavelengths of the microwave signals are in the range of about 15–150 cm which is much larger than the dimensions of the resonator itself.

It is known how to excite dielectric and parallel-plate resonators by simple probes or loops. In most practical cases the thickness of a parallel-plate resonator is much smaller than the microwave wavelength in order for the resonator to support only the lowest is order TM-modes and in order to keep the DC voltages, which are required for the electrical tuning of the resonators with nonlinear dielectric fillings, as low as possible. This is discussed in Gevorgian et al., "Low Order Modes of YBCO/STO/YBCO Circular Disk Resonators" IEEE Trans. Microwave Theory and Techniques, Vol. 44, No. 10, October 1996. This document is also incorporated herein by reference.

However, some microwave devices, such as for example passband filters, often require strong (i.e. near-critical or over-critical) input/output couplings. To achieve such strong couplings in resonators or devices based on thin parallel-plate disk resonators, particularly having an extremely high dielectric constant such as STO, it is practically impossible to use known coupling arrangements such as loop or probe couplers, for example as discussed in Kajfez, Guillon: Dielectric resonators, 1990, chapter 8, and e.g. page 282, chapter 6.6.

Probe coupling, which is a coupling mainly to the electrical field, is not efficient since almost all the microwave power is reflected from the walls of the resonator. Because of the extremely high dielectric constant of for example STO, the walls of the resonator serve as near perfect magnetic walls with reflection coefficients close to 1 which follows from a simple relationship:

$$\Gamma=(\sqrt{\epsilon}-1)/(\sqrt{\epsilon}+1)$$

Γ being the reflection coefficient and E being the dielectric constant.

Furthermore, known loop couplings (coupling to the magnetic field) are also not efficient. In a thin parallel-plate resonator with only TM-modes, the magnetic field lines are parallel to the plates of the resonator. Because of the small thickness of the resonator only a small amount of the magnetic field lines of the external traditional coupling loop is matched to the magnetic field lines inside the resonator and the matching cannot be increased by making the area of the coupling loop larger.

T. Hayashi et. al., "Coupling structures for superconducting disk resonators, Electronic Letters", Vol. 30, No. 17, pp. 1424–1425, 1994, has suggested an enhanced capacitance coupling arrangement to achieve a strong input/output coupling in filters based on microstrip parallel-plate resonators. This arrangement is however only effective for dielectric resonators in which the dielectric has a low dielectric constant, approximately between 10–20. Such resonators are much too large for a number of applications Still further it is only effective for the fundamental TM 110-mode.

K. Bethe, "Über Das Mikrowellenverhalten Nichtlinearer Dielektrika", Philips Res. Reports, Suppl. 1970, No. 2, p. 44 shows rectangular waveguides for TM 110-mode input/output couplings for high dielectric constant parallel-plate resonators, for example of STO. However, the coupling arrangement is bulky and not at all suitable for small size applications An additional DC-biasing arrangement is required which is disadvantageous since it introduces reactances into the microwave circuit which results in a degradation and reduction of the quality factor and of the overall.

Vendik et. al., Electronic Letters, Vol. 31, p. 654, 1995 discloses a coaxial waveguide for TM 020-mode input/output couplings for a resonator comprising a substrate with a high dielectric constant. The coupling is then applied through the central rod of a coaxial line. For tuning purposes external bias tees are used. The coupling arrangement of this device is bulky and also not appropriate for small resonators or small devices in general.

Furthermore the biasing arrangement also introduces reactances into the microwave circuit resulting in a performance degradation. High dielectric constant parallel-plate resonators, for example comprising diaelectrics of STO, have a high mode density This makes the use of traditional probe and loop coupling arrangements disadvantageous since they provide approximately the same coupling for all modes. In a number of cases only one mode should be excited. In for example narrow band filters only one mode is desired while the other modes create spurious transmissions in the rejection band and hence degrades the overall performance of the filter. To avoid this problem mode selective input/output coupling arrangements are needed.

Another disadvantage of the known arrangements is that electrically tunable parallel-plate resonators based on non-linear dielectrics, such as for example STO, require external DC biasing (in the form of ohmic contacts to the metallic plates of the resonator) in order to control the resonant frequency. According to the Swedish Patent Applications, by the same applicant, 9502138-2 and 9502137-4, (corresponding to U.S. patent application Ser. No. 08/985,149, which has been allowed, and Ser. No. 08/989,166, respectively) DC biasing is provided through introduction of an additional arrangement into the resonator design. Such an arrangement however affects the resonant frequency and furthermore it may deteriorate the quality factor (Q) of the resonator.

Finally a number of resonators are known which are based on ferromagnetic resonances. The resonant frequency is then determined by the microscopic properties of the materials used such as ferromagnetic resonance, anti-ferromagnetic resonance, electronic paramagnetic resonance etc. (and the dimension of the resonator is not given by the frequency of the wavelength of the microwave signal). In such resonators the lowest resonant frequency is limited by material properties, and the size of the material used in the resonator is usually made arbitrary small and not related to the wavelength of the microwave signal. The magnetic coupling loops used for such resonators are designed so as to provide a uniform magnetic field distribution in the ferrite. A mode selection is then not possible. An example of such a filter with the associated coupling arrangements is for example shown in U.S. Pat. No. 4,197,517. Also U.S. Pat. No. 4,945,324 shows an example on such a magnetic filter.

SUMMARY

What is needed is therefore an arrangement for coupling electromagnetic waves, particularly microwaves, into and/or out of a microwave device which has small dimensions and which can be used in the frequency bands in which most of the advanced microwave communication systems operate and which has a high performance. Particularly an arrangement and a device are needed in which the mode selection in an efficient and reliable way is enabled.

Particularly an arrangement is needed through which a mode can be selected and excited without the degradation of the overall performance of the arrangement and through which particularly the desired coupling strength can be obtained. Particularly an arrangement is needed which comprises a mode selective input/output coupling arrangement for thin parallel-plate (or coplanar) resonators having a substrate with an extremely high dielectric constant material.

More particularly still an arrangement is needed through which a strong input/output coupling can be provided and still more particularly an arrangement is needed through which tuning through DC biasing can be provided substantially without deterioration of the Q-value (the quality factor) of the resonator.

Still further a method is needed through which electromagnetic waves, particularly microwaves, can be coupled into/out of a microwave device such as e.g. a resonator in an efficient manner, and in which coupling to one or more modes can be selected.

Particularly an arrangement is needed which permits controlling of the strength of the coupling in a wide range as well as an arrangement through which a very strong coupling can be provided for a selected mode (or more than one selected mode). Particularly a method is needed which enables the application of DC biasing without deteriorating the Q-value of the microwave device, more particularly without requiring the use of separate or additional tuning means which affect the performance of the device in a negative sense.

Therefore an arrangement as referred to above is provided in which the dimensions of the resonator and the coupling loop are related to the resonant frequency of the resonator(s) and wherein the coupling loop has such a geometry and is arranged in relation to the resonator such that the magnetic field lines match the internal field distribution of at least one mode of the resonator(s) so that only the selected mode is excited, coupling being provided only for such mode(s). The linear dimensions of the coupling loop are comparable to, or larger than, the dimensions of the resonator Since E is high (or even very high), the dimensions of the resonator are small.

Particularly an arrangement is provided wherein the coupling loop has such a geometry and is arranged in such a way that azimuthally degenerate modes are excited so that the resonator operates in multiple mode regime. Particularly the resonator comprises a thin parallel-plate resonator In an advantageous embodiment the non-linear dielectric material comprises a dielectric with an extremely high dielectric constant, for example a ferroelectric/antiferroelectric material, even more particularly STO. Advantageously the resonant frequency of the resonator is between 0.5–3 GHz, i.e. in the frequency region of cellular communication systems.

In an advantageous embodiment the coupling loop comprises a coaxial lines particularly the central wire of a coaxial cable. Advantageously, according to one embodiment, the coupling loop at least partly surrounds the resonator in the radial direction. According to different embodiments for example the TM 110- or the TM 020-modes are excited. The length of the coupling loop is particularly much shorter then the wavelength of the excited microwave in free space. In a particular embodiment the coupling loop, for example the central wire of a coaxial cable, makes a number of turns around the resonator wherein the number of turns around the resonator (and the distance from the resonator) gives the strength of the coupling. This strength of the coupling can thus be controlled; in brief, the more turns, the stronger the coupling.

In another embodiment the coupling loop is arranged so as to form a half turn loop around the resonator. In that case the coupling strength is given by the perpendicular distance from the plane of the resonator (the plane facing the loop) to the coupling loop. Thus, in this case the coupling strength can be controlled by the distance from the coupling loop to the resonator plate.

According to different embodiments the resonator is circular, square-shaped, rectangular, triangular etc., for each of which the modes having particular field distributions, coupling loops are provided to enable coupling only to the selected mode(s).

In an advantageous embodiment, in which the TM 110-mode is selected, the central wire of a coaxial line is arranged a number of turns around the resonator, which for example is a circular resonator. Alternatively the loop comprises the central wire of a coaxial cable and it forms a half turn loop around the half of, for example, a circular resonator. Advantageously near-critical or over-critical coupling is provided.

In a particularly advantageous embodiment one end of the coupling loop is connected to one of the resonator plates, the other resonator plate for example being connected to ground, and a DC-biasing signal is applied through the coupling loop, thus enabling electrical tuning of the resonator. The DC-biasing is applied via external standard bias tees to the loop which are not shown in the drawings. Through the coupling arrangement is thus provided for mode selection, DC tuning and coupling strength controlling through the use of but one and the same arrangement, i e. the coupling arrangement itself and thus no additional DC-biasing arrangements are required which connect to the resonator, which is extremely advantageous.

In a particular embodiment the coupling loop is connected to the midpoint of for example one of the plates of a circular parallel-plate resonator after making a number of turns around the resonator, thus exciting the TM 110-mode. A circuit for DC-biasing is provided (not shown) which is connected to the coaxial wire.

According to another embodiment the TM 020-mode is excited and the resonator comprises a half disk resonator. The coupling loop is then for example connected to the midpoint along the diameter of the half disk resonator and a DC-biasing signal can be applied through the coupling loop also in this case.

According to another embodiment, in which the TM 020-mode is excited, the coupling loop extends, and is connected, perpendicularly to one of the resonator plates of the circular resonator, the length of the central wire of for example a coaxial cable giving the coupling strength. Also in this case is thus DC-biasing enabled. In an another embodiment, in which also the TM 020-mode is selected, the resonator comprises a semi-circular disk and the coupling loop comprises a quarter turn loop connected to the midpoint of the diameter of one of the resonator plates, thus also in this case enabling DC-biasing through the coupling loop. Irrespectively of which mode is to be excited, and thus is selected, a coupling loop can be arranged in different ways, either connecting to one of the resonator plates or not, thus enabling or not for DC-biasing through the coupling loop It should be noted, however, that through connecting the coupling loop to one of the resonator plates, extremely advantageous embodiments are provided since they combine three features, namely controlling of the coupling strength in a wide range, efficient mode selectivity and DC-biasing.

According to a still another embodiment the coupling loop comprises a thin film strip which may comprise a straight strip or a patterned strip. A patterned strip may for example be so designed as to excite azimuthally degenerate modes so that the resonator operates in multiple modes. If a film strip is used, the coupling strength is to some extent given by the width of the strip, but mainly by the height of a dielectric spacer layer arranged on top of the normal conducting plate.

In an advantageous embodiment the dielectric substrate comprises a dielectric bulk material.

In other embodiments of the invention the dielectric substrate comprises a thin film, for example of a ferroelectric material. In one such embodiment the resonator is rectangular and comprises a coplanar waveguide. The selected mode typical for such resonators is the TME-mode.

In particular, embodiments can additionally be provided for optical tuning and/or temperature tuning, e.g. if no DC-biasing is provided for, or in combination therewith, should it be wanted.

A method as referred to above is also provided which comprises the steps of selecting a mode of the resonator which is to be excited (alternatively there may be more than one selected mode) arranging a coupling loop, the length of which at least is comparable to the dimensions of the resonator, in such a way that the magnetic field lines around the coupling loop match the internal field lines of the mode or modes to be excited; coupling a microwave signal into or out of the microwave device. Advantageously the method also comprises the step of providing a DC-biasing signal through the coupling loop to the resonator, the coupling loop being electrically connected to the resonator.

BRIEF DESCRIPTION OF THE DRAWINGS

The invention will in the following be further described in a non-limiting way under reference to the accompanying drawings in which:

FIG. 7 is still another embodiment of a coupling arrangement for the TM 020-mode without DC-biasing, FIG. 8 shows a thin film strip coupling arrangement.

DETAILED DESCRIPTION

Figure 1:
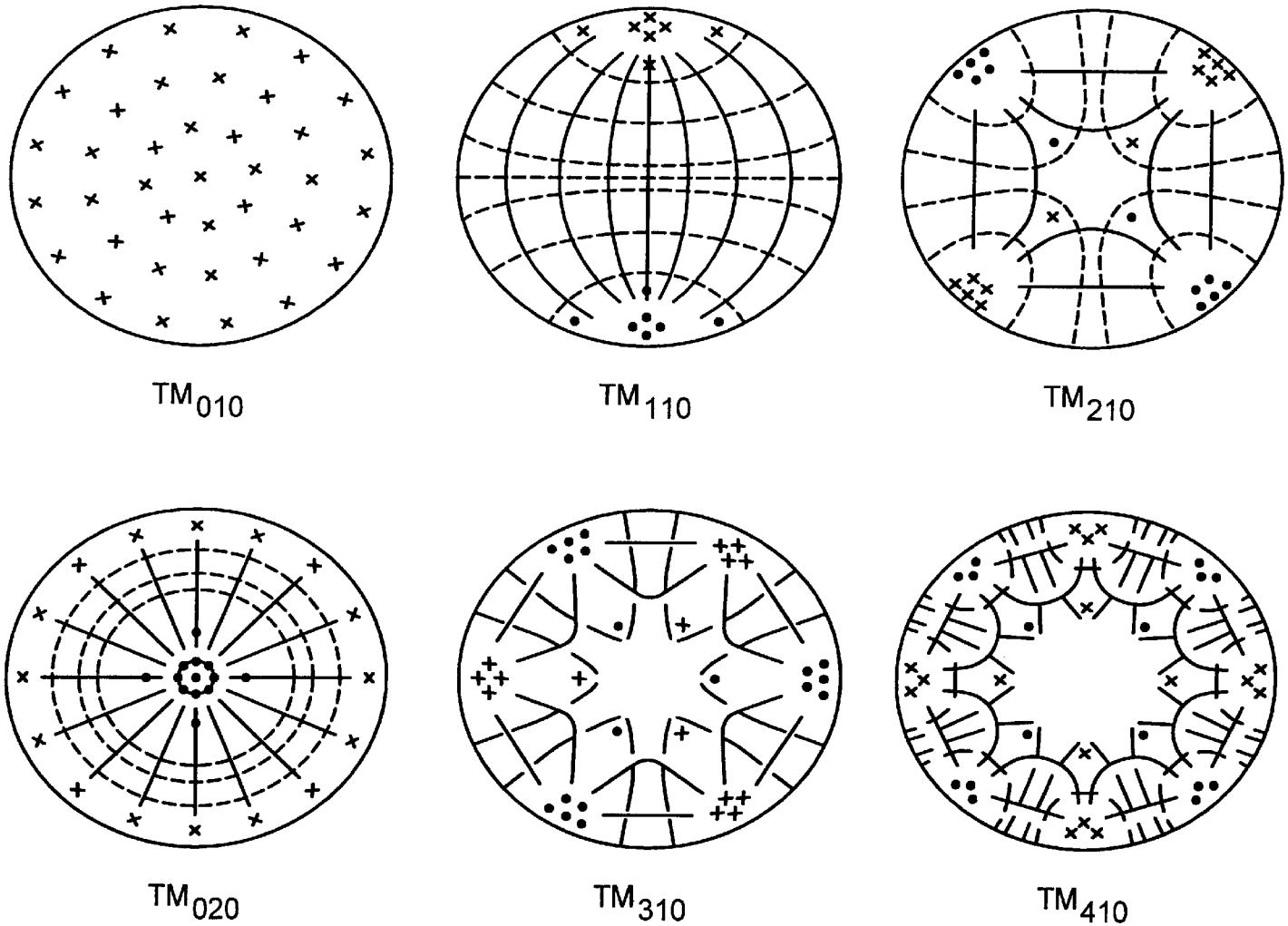
FIG. 1 schematically illustrates the lower order mode field distributions for a circular parallel-plate resonator.

FIG. 1 depicts, for illustrative purposes the lower order $TM_{nmp}$ mode field distributions for a cellular parallel-plate resonator illustrated, i.e. the TM 010-, TM 110-, TM 210-, TM 020-, TM 310- and TM 410-modes. Solid lines indicate the current, dashed lines indicate the magnetic field and dots and crosses illustrate the electric field. It is presumed that p=0; i.e. that the thickness of the disk is smaller than half a wavelength and the resonator only supports $TM_{nm0}$ modes.

Figure 2:
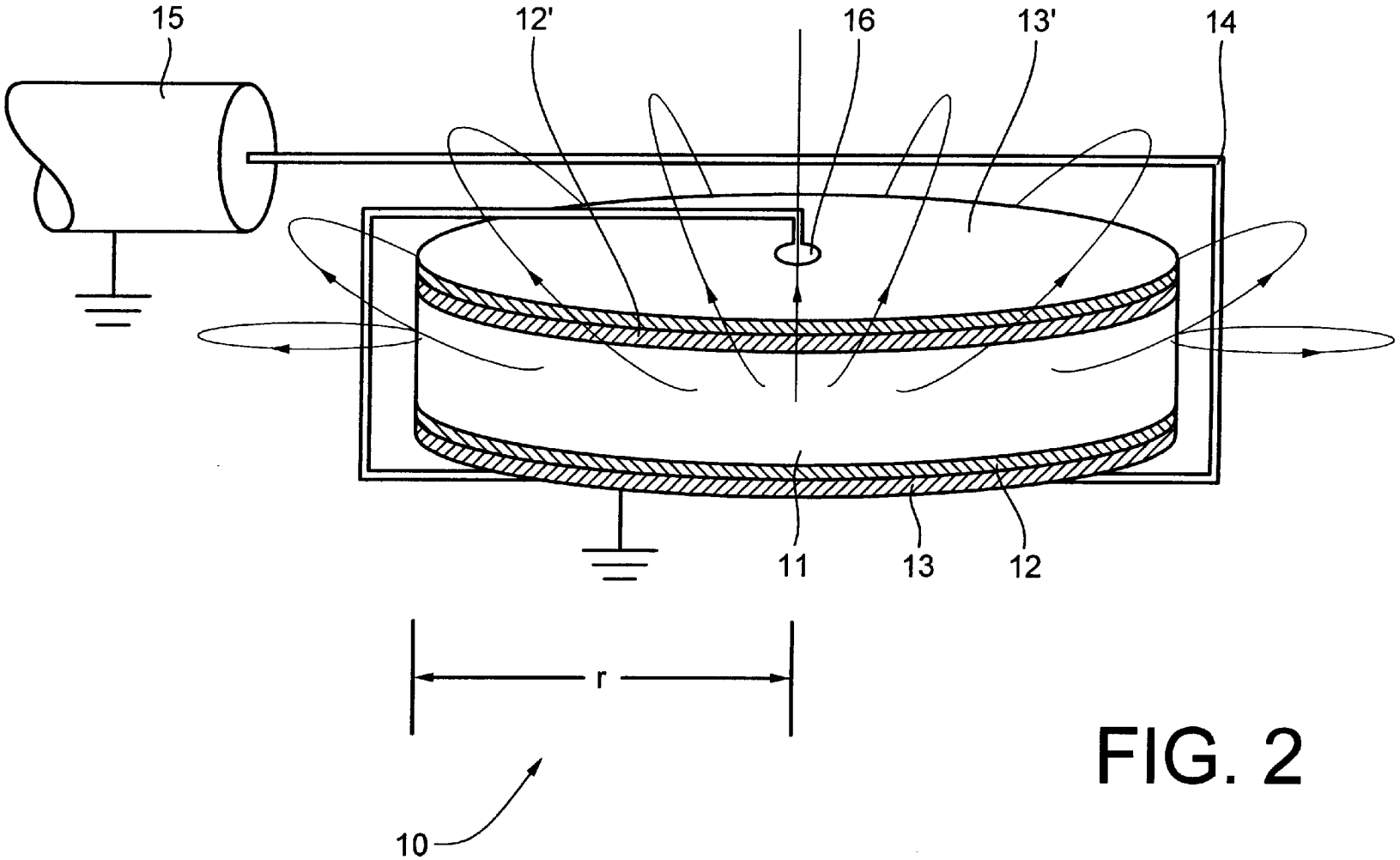
FIG. 2 shows an embodiment comprising a coupling arrangement for the TM 110-mode.

In FIG. 2 an arrangement 10 for coupling microwaves into and out of a thin parallel-plate microwave resonator is shown. The term tin is defined here as thin in comparison with the wavelength of the microwave signal in free space ,$\lambda_0$, and more specifically $$h<\lambda_g/2$$

h being the thickness of the resonator and $\lambda_g$ being the wavelength in the resonator. The parallel-plate microwave resonator comprises a dielectric substrate 11 having a high dielectric constant such as for example STO. The dielectric substrate 11 here comprises a circular disk and the resonator is formed by said high dielectric constant substrate 11 and two film plates 13,13' arranged on either side of the circular disk, thus forming a parallel-plate resonator. The plates may comprise a normal metal such as for example gold, silver etc. In an advantageous embodiment, shown in FIG. 2, superconducting layers 12,12' are arranged between the dielectric substrate 11 and the thin film plates 13,13. Particularly the superconducting films 12,12' comprise high temperature superconducting materials, for example YBCO. However, the superconducting layers are not necessary for the functioning of the present invention but they merely relate to advantageous embodiments Because of the extremely high dielectric constant of the dielectric substrate 11, e.g. STO, the size of a resonator operating in the frequency band between 0.5–2.0 GHz is small. The radius r at the resonant frequency f of such a circular disk resonator is given by the relation $$r=c_0k_{nm}/2\pi f\sqrt{\epsilon}$$

$c_0$ being the velocity of light in free space, $k_{nm}$ being the m:th zero of the derivative of the Bessel function of order n, and $\epsilon$ being the dielectric constant. For a STO disk resonator as shown in FIG. 2 which operates below 100K the radius is typically less than 1 cm which is much smaller than the free space wavelength of microwave signals at this frequencies which may be about 15–60 cm.

In contrast to hitherto known coupling arrangement the coupling arrangement of the present invention makes use of said large difference between free space wavelength and the size of the resonator, or more specifically, the linear dimensions of the coupling loops are comparable to, or larger than, the dimensions of the resonator itself. As can be deduced from the above formula, for a high (very high) $\epsilon$, r gets very small. At frequencies of about 0.5–3.0 GHz, the dimensions of the resonator, e.g. the radius, are much smaller than $\lambda_0$, and particularly the length of the coupling loop is smaller than $\lambda_0/8$ to $\lambda_0/10$. This suggests that the coupling loop is a lumped element, as an industance. Since $\epsilon$ is very high, $\lambda_0$ is much larger than the dimensions of the resonator. The length of the loop is smaller than $\lambda_0$. Furthermore, since $\epsilon$ is high, for the field inside the resonator, the resonator is a distributed circuit or element. $\lambda_g$ inside the resonator is proportional to $\lambda_0/\sqrt{\epsilon}$. $\lambda_g$ is thus comparable to the size of the resonator, and the resonator appears long, or distributed.

In known arrangements, in which a resonator with a dielectric substrate having a low dielectric constant, is used, the loop is much smaller than $\lambda_0$ and the loop is smaller than the dimensions of the resonator.

In the embodiment of FIG. 2 the coupling arrangement comprises a coupling loop 14 comprising the central wire of a coaxial cable 15. The coupling loop, i.e. the central wire of the coaxial cable 15 forms a loop around the parallel-plate resonator to provide near-critical or over-critical coupling. Through the geometry and the way the coupling loop is arranged in relation to the circular parallel-plate resonator the TM 110-mode is excited. The coupling loop 14 is in this case much shorter than the free space wavelength of the excited microwave and in the embodiment shown in FIG. 2 the coupling loop 14 is wound around the resonator and makes a two-turn loop around it. The coupling loop 14 acts as a lumped inductor seen from the external microwave circuit, i.e. the coaxial input line 15. The end 16 of the coupling loop 14 is electrically connected to (or has an ohmic contact to) the midpoint of one of the plates 13' of the resonator. It is also assumed that the external wire of the coaxial line 14 is connected to ground as well as the other resonator plate 13, or, they are connected electrically. Since the magnetic field lines around the coupling loop 14, i,e. the central wire of the coaxial line 15, have the same pattern as the magnetic field lines of the fundamental TM 110-mode of the parallel-plate resonator, as can be seen from FIG. 1, this mode is selectively excited in the resonator, as already referred to above and the coupling strength, including the highly overcoupled case, is here determined by the number of turns of the coupling loop 14 around the resonator and by the distance from the loop to the resonator plates; see the next embodiment. In brief, the more turns, the higher the coupling strength. Thus the coupling strength can be controlled or adjusted by changing the number of turns around the resonator If a coupling strength of a given magnitude is desired, the appropriate number of turns are found and the coupling loop is arranged in agreement therewith. An arrangement 10 as disclosed in FIG. 2 is particularly useful when DC-biasing is used for electrical tuning of the parallel-plate resonator having a non-linear dielectric substrate The DC-bias is in this case applied to the resonator through the end 16 of the coupling loop. This means that DC-biasing can be provided without having to use an additional DC-biasing arrangement. In FIG. 2 the magnetic field lines of the coupling loop and the parallel-plate resonator are illustrated The DC-bias is applied through an external power supplier via a standard bias tee (not shown) connected to input line 15.

Figure 3:
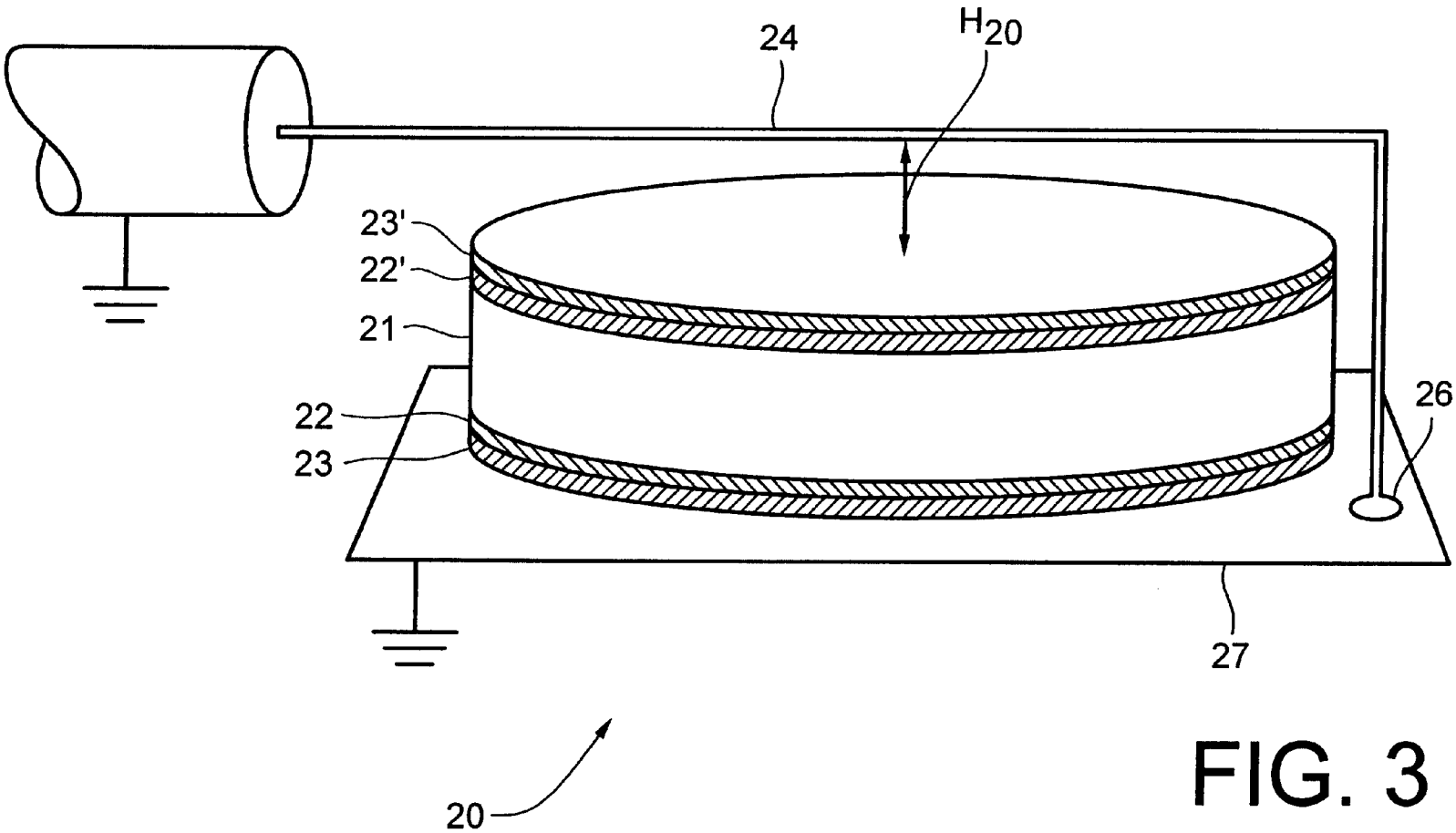
FIG. 3 shows another embodiment comprising a coupling arrangement for the TM 110-mode using a half-turn loop.

In FIG. 3 another arrangement 20 is illustrated in which coupling to the TM 110-mode is provided through the use of a half-turn coupling loop 24. Also in this case the thin parallel-plate resonator comprises a dielectric substrate 21 having a high dielectric constant, e.g. STO, on each side of which thin film plates 23, 23' are arranged. Between the dielectric substrate 21 and the thin film plates for example of Au, Ag or similar thin superconducting films 22, 22' may be arranged. As in the preceding case the superconducting films 22, 22' are not necessary for the functioning of the present invention. However, in a particularly advantageous embodiment they may comprise high temperature superconducting films. The coupling loop 24 is formed by the central wire of a coaxial line 25. However, in this case the coupling loop forms a half-turn loop and the magnetic field lines around the central wire 24 have the same pattern as the magnetic field lines around the resonator. Since they have the same pattern as those of FIG. 2, they are not illustrated in the Figure.

In FIG. 3 coupling loop 24 is not connected to the resonator but to a plate 27 which may be superconducting and on which the resonator is arranged 27. The external wire of the coaxial line 25 is connected to ground as well as the superconducting plate 27 on which the resonator is arranged, or they are electrically connected. As referred to above, also in this case the TM 110-mode is excited. The coupling strength between the resonator and the coupling loop 24 is here given by the distance $H_{20}$ between the resonator, or particularly the plate of the resonator that is adjacent to the coupling loop 24, and the coupling loop 24, and thus the coupling strength can be controlled by changing the distance between the coupling loop 24 and the upper (in this case) conducting plate 23'. In the arrangement of FIG. 3 however no DC-biasing possibility is provided through the coupling loop. Instead for example tuning may be provided via optical tuning or temperature tuning Alternatively of course additional, DC-biasing means may be provided.

Figure 4:
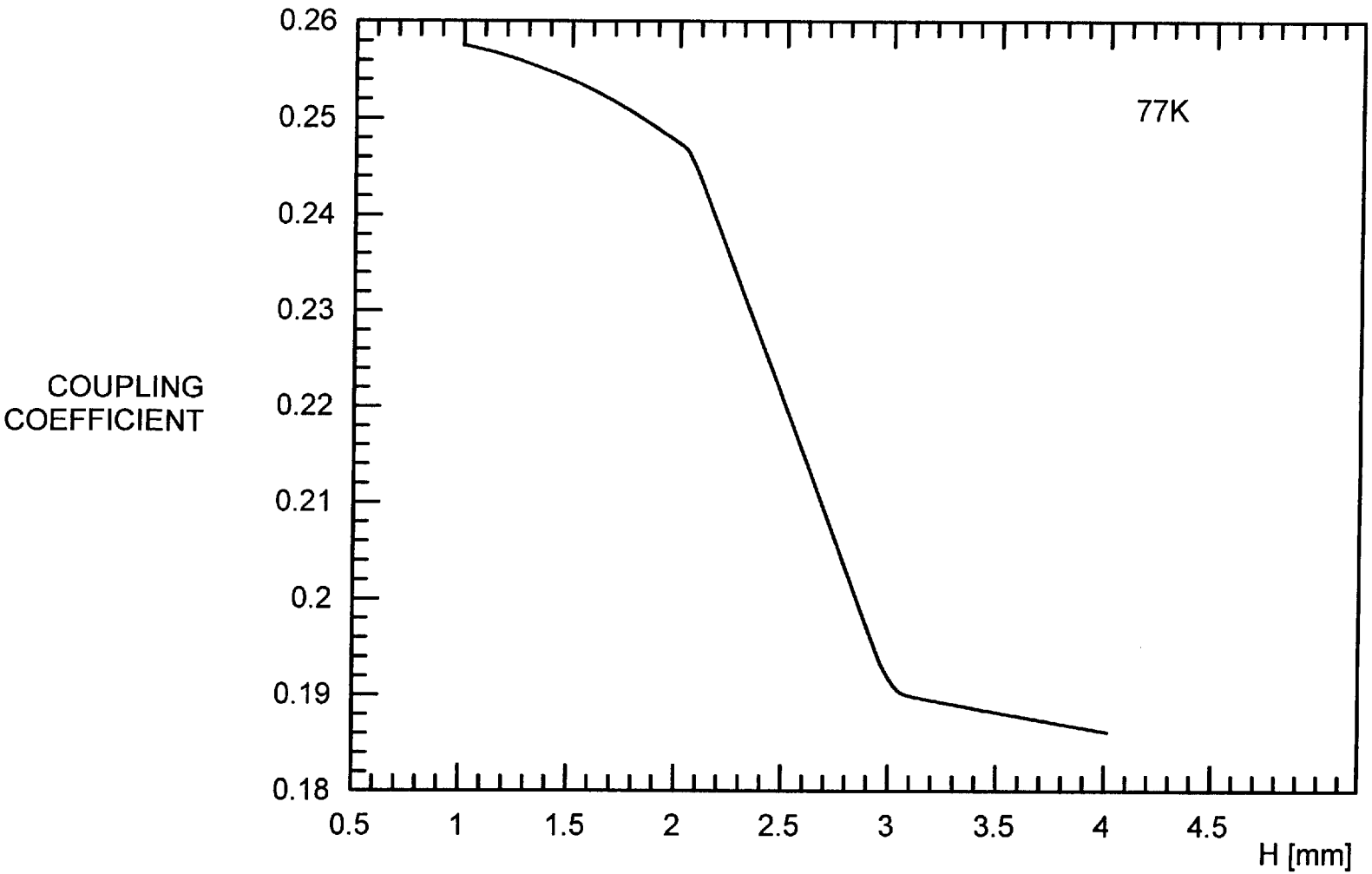
FIG. 4 is a diagram showing the dependence of the coupling coefficient on the distance from the coupling loop to the resonator for the coupling arrangement of FIG. 3.

In FIG. 4 the dependence of the coupling strength on the distance between the coupling loop and the resonator, $H_{20}$ in millimeters e.g. of FIG. 3 is illustrated at 77K.

Figure 5:
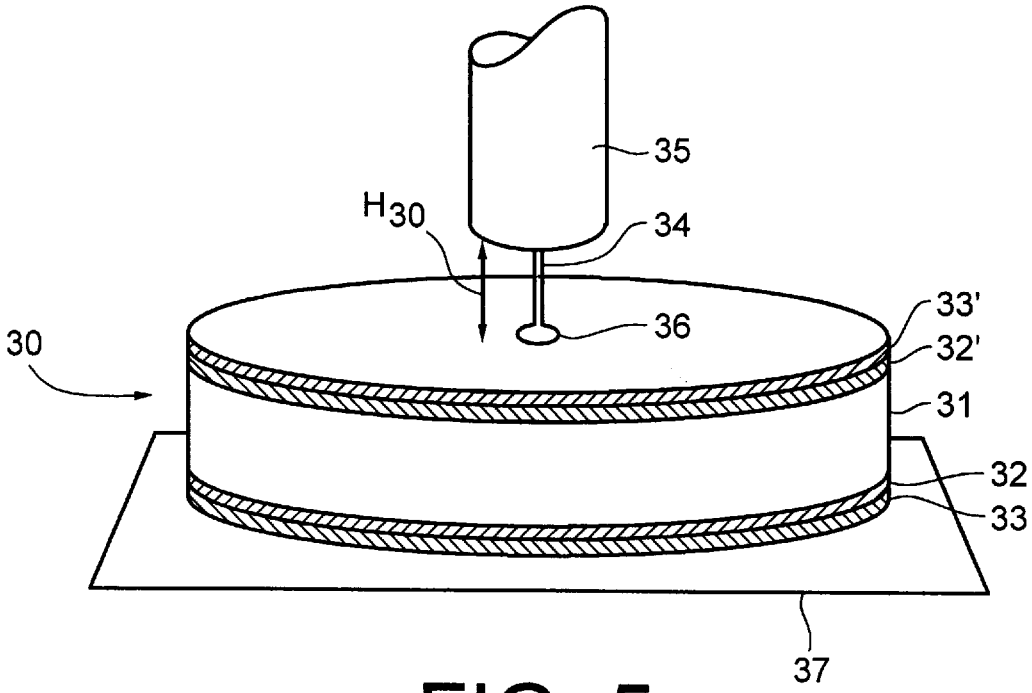
FIG. 5 illustrates an embodiment comprising a coupling arrangement for the TM 020-mode with DC-biasing.

In FIG. 5 an arrangement 30 is shown in which the TM 020-mode is selected for excitation. The parallel-plate resonator comprises a circular disk with a dielectric substrate 31 of a high dielectric constant, e.g. made of STO, on each side of which thin film plates 33, 33' are arranged which for example may be of a normal conducting material. In an advantageous embodiment thin superconducting films, particularly high temperature superconducting films, 32, 32' are arranged between the dielectric substrate 31 and the thin films 33, 33'. However, also in this case said superconducting films are not necessary for the functioning of the invention. The parallel-plate resonator is arranged on a preferably superconducting plate 37 The coupling loop 34 here comprises the central wire of a coaxial line 35 and it is connected at midpoint 36 of the upper plate 33' of the parallel-plate resonator in a perpendicular manner so that a perfect match between the magnetic field lines of the central wire 35 of the coaxial line 34 and the TM 020-mode of the resonator is provided. Thus both a tight and selective coupling is achieved. In a frequency band between 0.2–6.0 GHz only the TM 020-mode is excited with such an arrangement. In this embodiment the coupling strength is given by the distance $H_{30}$ in the figure which denotes the length of the coupling loop 34 Since the coupling loop 34 furthermore is electrically connected to the resonator, i.e. to the upper resonator plate 33', DC-biasing is enabled through the coupling loop 34 itself and thus no additional tuning means are needed.

Figure 6:
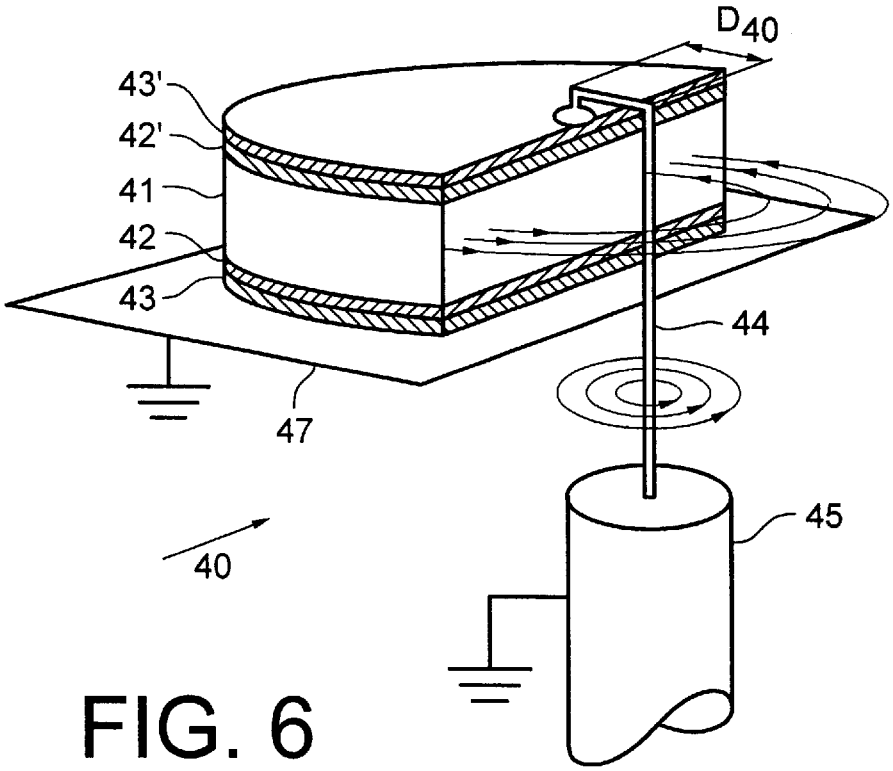
FIG. 6 is another embodiment of a coupling arrangement for the TM 020-mode with DC-biasing.

In FIG. 6 still another arrangement 40 for selective coupling of the TM 020-mode is illustrated. The parallel-plate resonator here comprises a semi-circular parallel-plate resonator comprising a dielectric substrate 41 on either side of which thin film plates 43, 43' are arranged which, as in the preceding embodiments, may comprise a normal conducting metal such as Au, Ag etc. Also in this case superconducting films 42, 42' are arranged between the normal conducting films 43, 43' and the dielectric substrate, although these are not necessary for the functioning of the invention but merely illustrate a particular, advantageous embodiment. The coupling loop comprises a quarter-loop 44, also here being the central wire of a coaxial line 45. The parallel-plate resonator is arranged on a preferably superconducting plate 47 which is connected to ground and the coaxial line 45 is likewise connected to ground. The central wire of the coaxial line 45, i.e. the coupling loop 44, is connected to the midpoint on the diameter of the semi-circular disk resonator. Since it is connected to one of the plates of the resonator, DC-biasing is enabled. In FIG. 6 the magnetic field lines around the central wire 44 of the coaxial line 45 have the same pattern as the magnetic field lines of the resonator, which also are illustrated, and which results in excitation of the TM 020-mode. The coupling strength is here given by the distance, $D_{40}$, that the coupling loop protrudes from the connection point or the distance from the resonator to the loop.

In FIG. 7 still another arrangement 50 is illustrated in which the TM 020-mode is selectively excited. The resonator comprises a semi-circular disk in which a dielectric substrate 51, for example of STO, is provided on either side of which thin film plates 53, 53' are arranged for example comprising a normal conducting metal. Thin superconducting films 52, 52' are arranged between the dielectric substrate 51 and the normal conducting film plates 53, 53' although the superconducting films also in this case are not indispensable for the functioning of the invention. The coupling loop 54 comprises the central wire 54 of a coaxial line 55, wherein the external wire of the coaxial line is connected to ground The parallel-plate resonator is arranged on a preferably superconducting plate 57 which is connected to ground.

The coupling loop 54 here comprises a half-turn loop which is connected to the normal conducting plate 57 at a point close the midpoint on the diameter of the parallel-plate resonator itself. Since the coupling loop 54 is not connected to the parallel-plate resonator itself, DC-biasing is not provided for as in for example FIGS. 5 and 6 however, tuning can be provided for in any desired manner, for example via separate DC-biasing means or by optical tuning or temperature tuning as is known per se or particularly described in the Swedish and U.S. patent Applications referred to earlier in the application filed by the same applicant and which herewith are incorporated herein by reference The coupling strength is here given both by the perpendicular distance $H_{50}$ from loop 54 to the adjacent resonator plate 53' and by the perpendicular distance $D_{50}$ from the loop to the flat end of the resonator.

As described in Swedish Patent Application No. 9502137-4, a variable DC voltage source can be provided for the application of a tuning voltage bias to the HTS films. The voltage is supplied via leads or conducting wires, and when a biasing voltage is applied, the dielectric constant of the nonlinear dielectric substrate is changed. In this way, a change in the resonant frequency (and the Q-factor) of the resonator is obtained.

It is also possible to use the temperature dependence of the dielectric constant of the nonlinear dielectric bulk material instead of the voltage dependence. The HTS films may be deposited on the surfaces of a dielectric resonator disc of a cylindrical or a rectangular shape, but the shapes can be chosen in an arbitrary way and the thin films can be deposited on at least two of the surfaces. In general, the low total loss of the device is due to the low dielectric loss of bulk single dielectric crystals, for example, ferroelectric crystals, and the low losses in the superconducting films, particularly HTS films. In bulk single crystal dielectrics, the nonlinear changes due to for example DC biasing (tunability) are larger than, for example, those in thin ferroelectric films as known from the state of the art. Furthermore, tunability is improved through the deposition of superconducting films which have a high work function for the charge carriers directly onto the surface of the dielectric or ferroelectric resonator. This prevents charge injection into the ferroelectrics and thus also the "electret effect" along with freeze-out of the AC polarization at the boundary. In parallel plate resonators, the HTS films may be covered by non-superconducting films, e.g., of normal metal for protection and serving as contacts for the voltage or current bias. The normal metal may for example be Au, Cu, or Ag or any other convenient metal. A further advantage of these protective films is that even in case of a failure in the cooling system used to maintain a sufficiently low temperature, the losses are kept at a low level. The resonant frequency may be thermally adjustable via a thermal adjusting means such as electrical heating spiral. Other appropriate heating means can of course be used, and they can be arranged in different ways.

In FIG. 8 an arrangement 60 is illustrated in which the resonator comprises a circular disk. The dielectric substrate 61 comprises a material with a high dielectric constant such as for example STO. Thin superconducting films (e.g. HTS-films) 62, 62' are arranged between thin normal conducting plates 63, 63' although also in this case the superconducting films are not necessary for the functioning of the invention. The parallel-plate resonator is arranged on a preferably superconducting plate 67 which is connected to ground. An additional thin dielectric film 69 is arranged on the contact layer 63'. On top of this dielectric layer 69 at least one thin film coupling strip 68 is defined, for example by photolithography or through any other known method. The thin film coupling strip 68 is so arranged as to cross the circular parallel-plate resonator along a diameter thereof and the thin film coupling strip 61 is connected to the central wire 64 of a coaxial line 65, the external wire being connected to ground. For example, a diametrically opposite end of the thin film coupling strip 68, i.e. the end opposite to the point in which it is connected to the central line of the coaxial cable, is connected to the superconducting plate 67. Through this arrangement a particularly high coupling coefficient is provided and it is more precisely spatially (and geometrically) defined as compared to the coaxial line loop as disclosed in the embodiments illustrated through FIGS. 2,3,5–7. In a particular advantageous embodiment the coupling strip is patterned to provide a particularly high selectivity and a higher (or lower) coupling strength. The coupling selectivity and the coupling strength for the TM 110-mode are given mainly by the thickness of the additional thin dielectric film layer 69 which also is denoted a spacer layer and to some extent by the width of the coupling strip 68 In order to avoid excitation of any possible degenerate modes, the symmetry of the coupling arrangement is important and for cases in which this is of a major concern, a photolithographical patterning of coupling strips is particularly advantageous.

In an alternative embodiment the coupling strip can be so designed as to particularly excite azimuthally degenerate modes. Thus it is designed in such away that the resonator operates in a multimode regime, for example in dual modes or in triple modes etc.

The principle for the coupling arrangements of the present invention can be applied to bulk parallel-plate resonators as well as to thin ferroelectric film devices.

Figure 9:
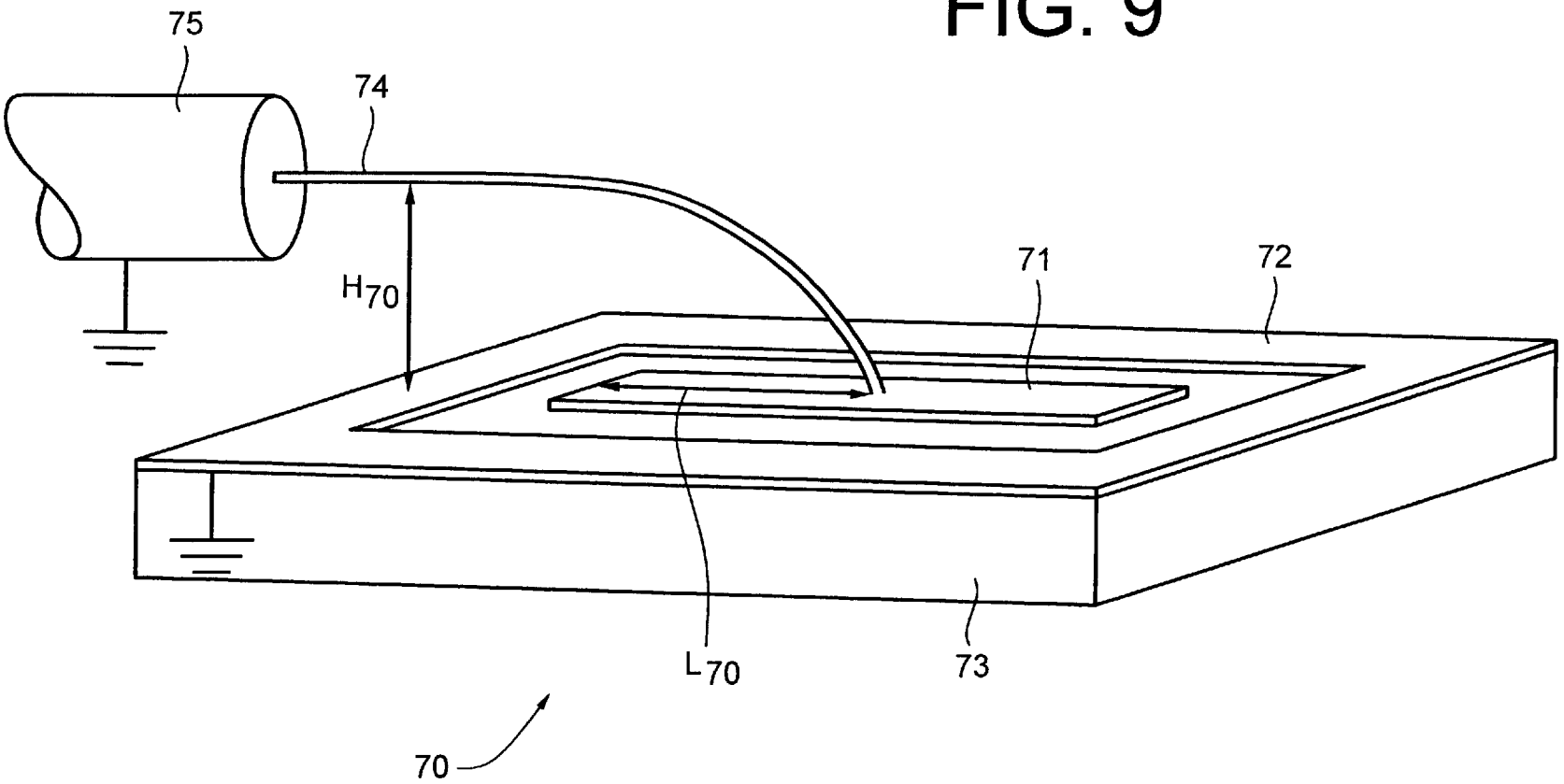
FIG. 9 shows a coupling arrangement for a thin film device

In FIG. 9 an arrangement 70 is illustrated in which a coplanar waveguide resonator is provided on top of a ferroelectric film/substrate 73. The coplanar waveguide resonator comprises a central strip 71 and another strip 72, both preferably of a superconducting material, in a particularly advantageous embodiment a HTS-material. In FIG. 9 $L_{70}$ is half the length of the resonator, thus giving the resonant frequency thereof. The resonator is excited by the coupling loop 74 which is formed by the central wire of the coaxial line 75, the external line of which is connected to ground. The plate 72 (normal conducting or superconducting), i.e. the external contact layer, is also connected to ground. The coupling loop 74 is connected to the central normal conducting or superconducting plate (strip) or contact layer 71. $H_{70}$ in the figure gives the coupling strength which thus can be controlled. Since the coupling loop 74 is connected to one of the contact layers, biasing is enabled through the coupling loop itself. For a coplanar waveguide is typically the (quasi) TME mode excited.

Although only a limited number of embodiments have been shown explicitly in the FIGS. 2–9, it should be clear that not only the TM 110- and the TM 020-modes can be selected and excited in this manner but that any mode can be selected for excitation, through choosing the appropriate resonator and the coupling arrangement being adapted to the particular mode.

Futhermore, the shape of the parallel-plate resonator does not have to be any of the shapes explicitly illustrated in the figures, but they can also have other shapes such as rectangular, triangular etc.

Furthermore an arrangement according to the invention can be used also if temperature tuning of the resonant frequency is used, i.e. by changing the temperature of the dielectric constant and/or the surface impedance of the superconducting films that may be arranged between the dielectric substrate and the contact layers e.g. the normal conducting planes. Furthermore optically induced tuning of the resonant frequency. for example by means of optical illumination of the superconducting films, can be used.

This is among others also discussed in the Swedish Patent Applications referred to earlier in this application, which are incorporated in the present application. The invention is also not limited to the use of superconductors.

Also in number of other aspects the invention can be varied in a number of ways without departing from the scope of the claims It is an advantage of the invention that in addition to enabling efficient mode selection, the coupling loops can be used to control the coupling strength. In particular embodiments can also a DC-bias be applied through the loop, which is extremely advantageous. Coupling arrangements according to the present invention provide most efficient small-size, high performance, devices.

What is claimed is:

1. An arrangement for coupling electromagnetic waves into and/or out of a microwave device comprising at least one dielectric resonator including a non-linear dielectric substrate with a high dielectric constant, and a coupling loop, wherein the dimensions of the resonator and the coupling loop are related to the resonant frequency of the resonator, the coupling loop having such a geometry and being arranged in relation to the resonator such that the magnetic field lines provided around the coupling loop match an internal field distribution of at least one mode of the resonator so that only said at least one mode is excited in the resonator, and coupling being provided only for said at least one mode, the coupling loop having a length nearly equal to, or larger than, dimensions of the resonator, and wherein one end of the coupling loop is connected to one of the resonator plates, DC-biasing being applicable through the coupling loop, thus providing for electrical tuning of the resonator.

2. The arrangement of claim 1, wherein the dielectric substrate comprises a thin film.

3. The arrangement of claim 2, wherein superconducting films are arranged between the dielectric substrate and the conducting plates.

4. The arrangement of claim 2, wherein the resonator is a coplanar resonator.

5. The arrangement of claim 1, wherein the non-linear dielectric material is either a ferroelectric material or an antiferroelectric material.

6. The arrangement of claim 1, wherein the resonant frequency of the resonator is between 0.5–3.0 GHz.

7. The arrangement of claim 6, wherein the coupling loop has a length smaller than approximately $\lambda_0/8$–$\lambda_0/10$, $\lambda_0$ being the wavelength in free space of the mode excited in the resonator.

8. The arrangement of claim 1, wherein the coupling loop at least partly surrounds the resonator.

9. The arrangement of claim 8, wherein the resonator is a thin parallel-plate resonator.

10. The arrangement of claim 8, wherein the dielectric substrate comprises a dielectric bulk material.

11. The arrangement of claim 8, wherein the coupling loop comprises a number of turns around the resonator.

12. The arrangement of claim 11, wherein the number of turns around the resonator determines the strength of the coupling, the strength of the coupling thus being controllable through arranging the appropriate number of turns around the resonator.

13. The arrangement of claim 11, wherein the coupling loop comprises a half turn loop around the resonator, the coupling strength being determined by a distance from the resonator to the coupling loop.

14. The arrangement of claim 11, wherein the at least one mode is a TM 110-mode of the resonator.

15. The arrangement of claim 1, wherein the coupling is one of near-critical coupling and over-critical coupling.

16. The arrangement of claim 1, wherein the coupling loop comprises at least one turn around the resonator and is connected to the midpoint of a resonator plate, and the at least one mode is a TM 110-mode.

17. The arrangement of claim 1, wherein the at least one mode is a TM 020-mode, the resonator comprising a half disk resonator.

18. The arrangement of claim 17, wherein the coupling loop is connected to the midpoint along the diameter of the half disk resonator.

19. The arrangement of claim 1, wherein the coupling loop extends and is connected perpendicularly to one of the resonator plates of a circular resonator, the coupling loop having a length determining the strength of the coupling.

20. The arrangement of claim 19, wherein the at least one mode is a TM 020-mode.

21. The arrangement of claim 19, wherein the dielectric substrate comprises a dielectric bulk material.

22. The arrangement of claim 1, wherein the coupling loop comprises a coaxial line.

23. The arrangement of claim 22, wherein the coupling loop comprises a central wire of the coaxial line, the coupling loop having a length that is much shorter than the wavelength of the excited mode in free space.

24. The arrangement of claim 19, wherein the dielectric substrate comprises a thin film.

25. The arrangement of claim 1, wherein the coupling loop is so arranged that azimuthally degenerate modes are excited, and wherein the resonator operates in multiple modes, said at least one mode being among the degenerate modes and multiple modes.

26. A method of coupling microwave signals into/out of a microwave device comprising at least one dielectric resonator with a nonlinear dielectric substrate having a high dielectric constant, comprising the steps of:

selecting a mode of the resonator which is to be excited, arranging a coupling loop, the coupling loop having a length which is nearly equal to, or larger than, dimensions of the resonator in such a way that the magnetic field lines provided around the coupling loop match an internal field distribution of the mode selected to be excited, and coupling a microwave signal into/out of the resonator, wherein one end of the coupling loop is connected to one plate of the resonator, DC-biasing being applicable through the coupling loop, thus providing for electrical tuning of the resonator.

* * * * *